US011852339B2

(12) United States Patent
Beghi et al.

(10) Patent No.: US 11,852,339 B2
(45) Date of Patent: Dec. 26, 2023

(54) SWITCHING ASSEMBLY, SWITCHING MECHANISM AND GAS COOKER

(71) Applicant: ELECTROLUX APPLIANCES AKTIEBOLAG, Stockholm (SE)

(72) Inventors: Maurizio Beghi, Forli (IT); Zhi Tan, Hangzhou (CN); Benny Zhu, Hangzhou (CN)

(73) Assignee: Electrolux Appliances Aktiebolag, Stockholm (SE)

( * ) Notice: Subject to any disclaimer, the term of this patent is extended or adjusted under 35 U.S.C. 154(b) by 335 days.

(21) Appl. No.: 17/275,694

(22) PCT Filed: Aug. 27, 2019

(86) PCT No.: PCT/EP2019/072785
§ 371 (c)(1),
(2) Date: Mar. 12, 2021

(87) PCT Pub. No.: WO2020/052961
PCT Pub. Date: Mar. 19, 2020

(65) Prior Publication Data

US 2022/0026064 A1 Jan. 27, 2022

(30) Foreign Application Priority Data

Sep. 14, 2018 (CN) ..... 201811073568.0

(51) Int. Cl.
*F23N 1/00* (2006.01)

(52) U.S. Cl.
CPC ..... *F23N 1/002* (2013.01); *F23N 2223/32* (2020.01); *F23N 2227/28* (2020.01); *F23N 2241/08* (2020.01); *F23N 2900/05004* (2013.01)

(58) Field of Classification Search
CPC .. F23N 1/002; F23N 2223/32; F23N 2227/28; F23N 2900/05004
(Continued)

(56) References Cited

U.S. PATENT DOCUMENTS 4,663,601 A 5/1987 Troutman
5,478,977 A 12/1995 Beasley
(Continued)

FOREIGN PATENT DOCUMENTS

KR 101885041 8/2018

OTHER PUBLICATIONS

International Search Report and Written Opinion for PCT/EP2019/072785 dated Nov. 6, 2019, 10 pages.
(Continued)

*Primary Examiner* — Avinash A Savani
(74) *Attorney, Agent, or Firm* — Pearne & Gordon LLP

(57) ABSTRACT

The present disclosure relates to a switching assembly for an ignition circuit of a gas cooker, a switching mechanism including the switching assembly, and a gas cooker including the switching mechanism. The gas cooker includes a gas valve structure configured for the passing through and cutting off of a gas, the gas valve structure includes a plunger and a valve housing, and the switching assembly includes: a permanent magnet carrier configured to be connected to the plunger to move between an initial position and a working position with the plunger; a permanent magnet fixed onto the permanent magnet carrier; a reed switch connected to the ignition circuit via a cable; a sealing structure configured to be provided at a connection segment between the reed switch and the cable so as to protect the connection segment from an environment where the switching assembly is located. When the permanent magnet carrier is in the initial position, a distance between the permanent
(Continued)

magnet and the reed switch allows the reed switch to be free from the effect of the permanent magnet; and when the permanent magnet carrier is in the working position, the permanent magnet is close to the reed switch so as to exert a magnetic effect on the reed switch.

18 Claims, 11 Drawing Sheets

(58) Field of Classification Search
USPC ..... 431/254
See application file for complete search history.

(56) References Cited

U.S. PATENT DOCUMENTS

2005/0224066 A1* 10/2005 Li ..... F24C 3/126
126/39 BA
2008/0003532 A1 1/2008 Gjerde

OTHER PUBLICATIONS

Brazilian Office action for app No. BR112021004273-3, dated Jun. 8, 2023, 4 pages.

* cited by examiner (a)

(b)

(a)

(b)

(a)

(b)

(a)

(b)

(a)

(b)

SWITCHING ASSEMBLY, SWITCHING MECHANISM AND GAS COOKER

FIELD

The present disclosure generally relates to the technical field of gas cookers, and in particular to a switching assembly of an ignition circuit in a gas cooker and a switching mechanism including the switching assembly.

BACKGROUND

This section provides background information related to the present disclosure which may not constitute the prior art.

A gas cooker generally includes a switching mechanism manually operable by an operator. The switching mechanism generally includes a gas valve structure for leading through and cutoff of gas and an ignition circuit for a spark plug. The gas valve structure and the ignition circuit can cooperate to ignite the gas cooker. The prior switch structure for switching on and off the ignition circuit is generally a mechanical switch structure, which generally includes two elastic metal sheets and an actuation member for actuating the two elastic metal sheets such that the two metal sheets is interconnected or disconnected, so as to switch on or switch off the ignition circuit.

However, water, oil stains, or other foreign substances may enter into the switching mechanism in use, which may results in jamming of a plunger of the gas valve structure, jamming and rusting of components of the mechanical switch structure, causing the ignition circuit to fail to ignite normally, and even causing the entire switching mechanism to fail to work properly.

Therefore, it is necessary to provide an improved switching assembly for the ignition circuit and a switching mechanism.

SUMMARY

An object of the present disclosure is to provide an improved switching assembly so as to improve the sealing performances such as waterproofing and anti-corrosion and the service life of the switching assembly.

Another object of the present disclosure is to provide a switching mechanism so as to improve the use reliability of the switching mechanism and simplify its structure.

Another object of the present disclosure is to provide an improved gas cooker so as to increase the service life of the gas cooker, simplify its structure, and reduce its cost.

It is provided according to an aspect of the present disclosure a switching assembly for an ignition circuit of a gas cooker which includes a gas valve structure configured for the passing through and cutting off of the gas, and the gas valve structure includes a plunger operable by an operator and a valve housing configured to receive the plunger. The switching assembly includes: a permanent magnet carrier configured to be connected to the plunger to move between an initial position and a working position with the movement of the plunger; a permanent magnet fixed onto the permanent magnet carrier; a reed switch connected to the ignition circuit through a cable; a sealing structure configured to be arranged around a connection segment between the reed switch and the cable such that the connection segment is sealed from an environment where the switching assembly is located. When the permanent magnet carrier is in the initial position, a distance between the permanent magnet and the reed switch allows the reed switch to be free from the effect of the permanent magnet to thereby maintain the ignition circuit in an off state; and when the permanent magnet carrier is in the working position, the permanent magnet is close to the reed switch such that the reed switch is switched on under the effect of the permanent magnet to thereby switch on the ignition circuit.

According to an embodiment, the switching assembly further includes a reed switch carrier, and the reed switch is carried by the reed switch carrier.

According to an embodiment, the reed switch carrier includes a housing part fixable to the valve housing of the gas valve structure, the housing part has an open box structure, and the connection segment between the reed switch and the cable is located in the housing part.

According to an embodiment, the reed switch is fitted in the housing part in a snap-fit manner; or the reed switch is integrally molded with the housing part.

According to an embodiment, the switching assembly includes a PCB mounted in the housing part, the reed switch and the cable are connected to each other by the PCB.

According to an embodiment, the sealing structure includes a sealant covering the connection segment between the reed switch and the cable.

According to an embodiment, the sealant is provided in the housing part merely at the connection segment between the reed switch and the cable; or the sealant is provided throughout an interior cavity of the housing part when the reed switch and the cable are installed in place.

According to an embodiment, the reed switch carrier further includes a cover part configured to cover an opening portion of the housing part in a shape-matching manner to define a hollow cavity between the cover part and the housing part, both the connection segment between the reed switch and the cable and the reed switch are accommodated in the hollow cavity.

According to an embodiment, the reed switch carrier has a through hole penetrating a bottom of the housing part and the cover part and having a diameter greater than that of the plunger, and the reed switch carrier can be fitted over the plunger via the through hole and be further fixed onto the valve housing of the gas valve structure.

According to an embodiment, the permanent magnet carrier is a cylindrical member that can be fitted over the plunger, and the cylindrical permanent magnet carrier includes a small-diameter portion and a large-diameter portion connected to each other, the permanent magnet is fixed in a wall of the large-diameter portion, and when the permanent magnet carrier is installed in place, the large-diameter portion is located in the hollow cavity of the reed switch carrier.

According to an embodiment, the permanent magnet carrier is a plate member that can be fitted over the plunger, and the permanent magnet carrier is located above the reed switch carrier when being installed in place.

According to an embodiment, the reed switch carrier is fixed to the valve housing of the gas valve structure via an attachment bracket.

According to an embodiment, the permanent magnet carrier is a cylindrical or plate-like member that can be fitted over the plunger.

According to an embodiment, the permanent magnet carrier is movable between the initial position and the working position as the plunger rotates; or the permanent magnet carrier is movable between the initial position and the working position as the plunger moves linearly; or the permanent magnet carrier is movable between the initial position and the working position as the plunger both rotates and moves linearly.

According to an embodiment, the permanent magnet is embedded in the permanent magnet carrier or is integrally molded with the permanent magnet carrier.

According to an embodiment, the permanent magnet has a rectangular shape, a sector shape or an annular shape suitable for exerting a magnetic effect on the reed switch as the permanent magnet carrier moves.

It is provided according to another aspect of the present disclosure a switching mechanism which includes a gas valve structure configured for the passing through and cutting off of the gas. The gas valve structure includes a plunger operable by an operator and a valve housing receiving the plunger, and the switching mechanism further includes the switching assembly according to any one of the above aspects.

It is provided according to another aspect of the present disclosure a gas cooker which includes the above switching mechanism and an ignition circuit. The ignition circuit includes a spark plug, the switching assembly of the switching mechanism is connected in the ignition circuit for switching on or off the ignition circuit.

According to the present disclosure, the reed switch is used in the ignition circuit of the gas cooker, which can help to avoid the issue of damage to the ignition circuit due to jamming or corrosion of the elastic metal sheets of the switch structure in the conventional technology, and can improve waterproof and anti-corrosive properties of the entire ignition circuit, and can improve the use stability of the ignition circuit. The reed switch is connected to the cable in such a manner that the connection segment therebetween is sealed (water-proofing, anti-corrosion, etc.) from the surrounding environment where the switching assembly is located, which can further improve the reliability of the entire ignition circuit. As a result, the reliability and service life of the gas cooker and its switching mechanism can also be improved. Moreover, the switching assembly according to the present disclosure can be combined with the conventional gas valve structures and gas cookers, has a simple structure, is convenient to install, and has a high applicability.

BRIEF DESCRIPTION OF THE DRAWINGS

The features and advantages of one or more embodiments of the present disclosure will become more readily understood from the following description with reference to the accompanying drawings in which.

DETAILED DESCRIPTION

Figure 1:
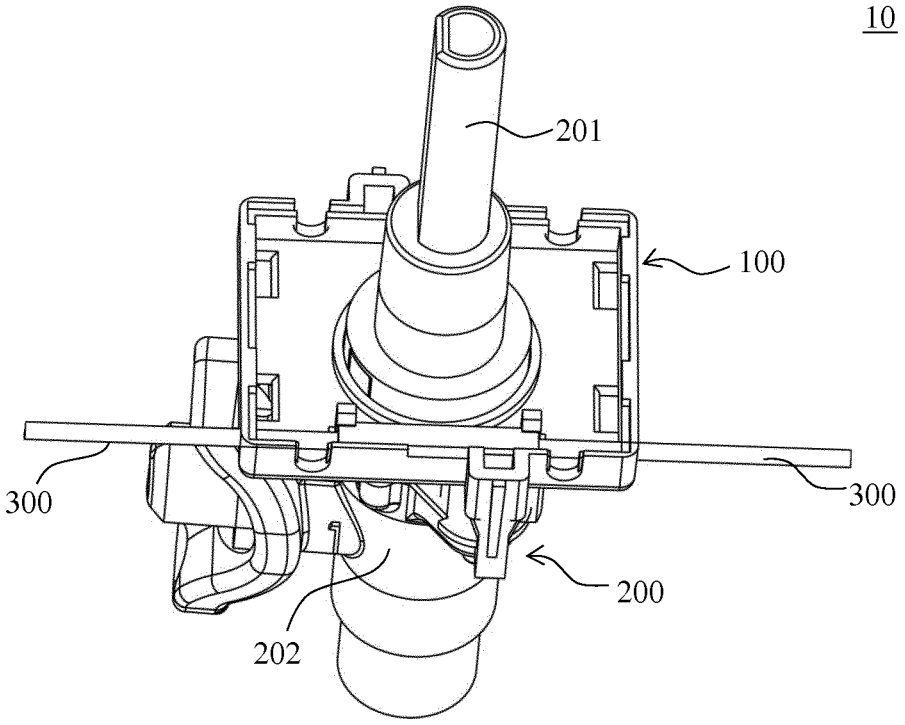
FIG. 1 shows a partial structural schematic view of a switching mechanism according to an embodiment of the present disclosure.

The following description of preferred embodiments is merely exemplary and is in no way intended to limit the present disclosure, its application, or uses. The same components are denoted by the same reference numerals in the respective drawings, and thus the configurations of the same components will not be repeatedly described.

For the convenience of description, a switching assembly and a switching mechanism according to the present disclosure will be described in detail below by taking the application in a gas cooker as an example. However, it can be understood that the switching assembly and the switching mechanism according to the present disclosure are not limited to the application in the gas cooker, and can also be applied to other structures and applications which are required to control the leading through and cutoff of fluid and the switching on and off of an electric circuit.

Figure 8:
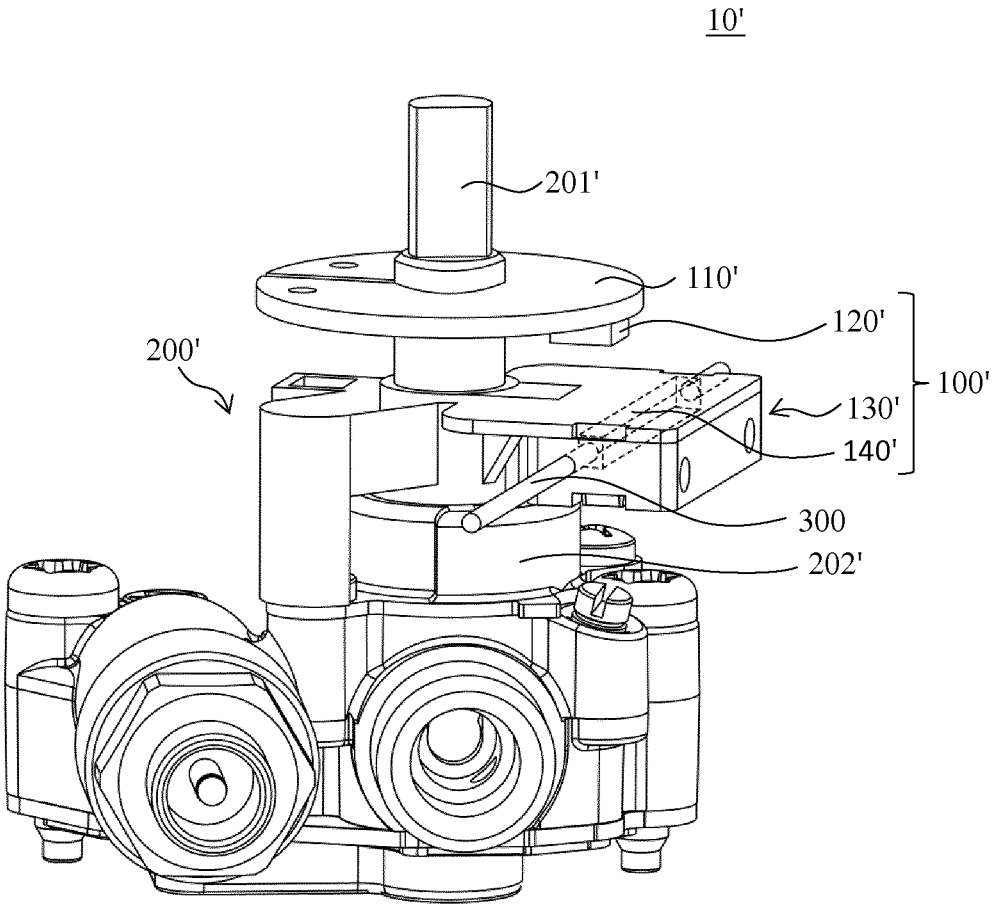
FIG. 8 schematically shows a perspective view of a switching mechanism according to another embodiment of the present disclosure.
Figure 9:
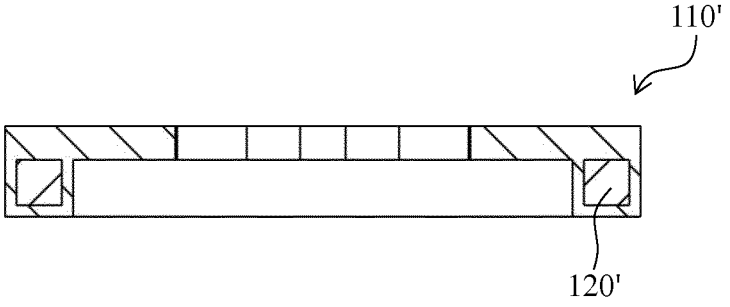
FIG. 9 schematically shows an assembled view of a permanent magnet with a permanent magnet carrier according to another embodiment of the present disclosure.
Figure 9:
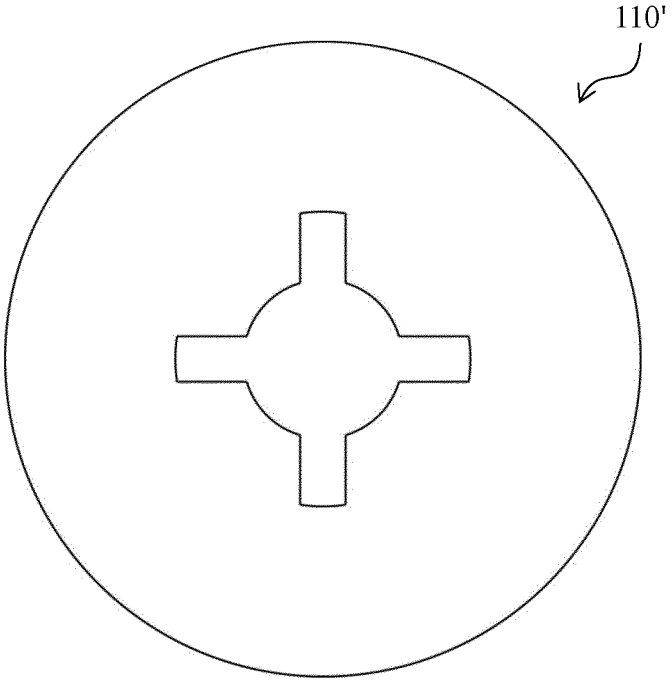
Figure 10:
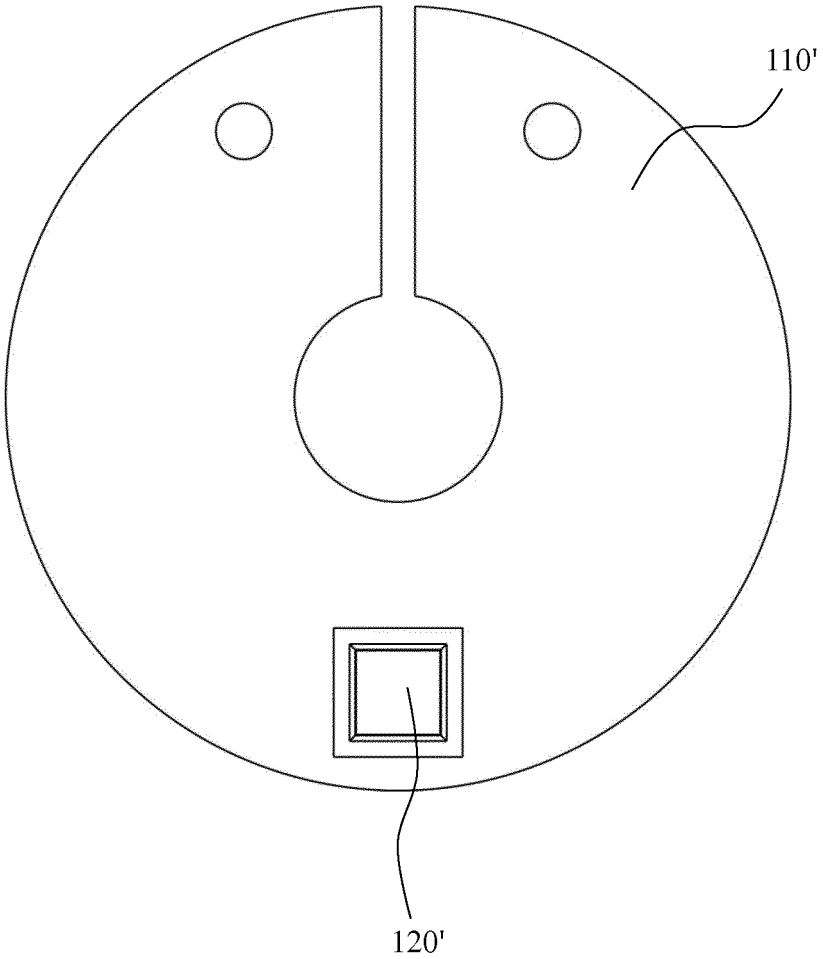
FIG. 10 schematically shows an assembled view of a permanent magnet with a permanent magnet carrier according to another embodiment of the present disclosure.

As is known, the gas cooker (e.g., a household gas cooker) generally includes a switching mechanism manually operable by an operator. When using the gas cooker, the operator can manually operate the switching mechanism to ignite the gas cooker. This kind of switching mechanism generally includes a gas valve structure and an ignition circuit. The gas valve structure generally includes a plunger (e.g., a plunger 201, 201' having a D-shaped cross-section as shown in FIGS. 1 and 8) and a valve housing (as indicated by 202 and 202' in FIGS. 1 and 8) receiving the plunger. Generally, the plunger may be provided with an operation knob (not shown in the figures) operable by an operator. The operator can actuate the gas valve structure, by rotating or pressing the operation knob, so as to allow the gas to pass through. The ignition circuit generally includes a spark generator, a spark plug, a power supply, and a switching assembly. The conventional ignition circuit generally employs a mechanical switch structure as a switching assembly for the ignition circuit. Such kind of switch structure generally includes two elastic metal sheets and an actuation member for actuating the two metal sheets. The actuation member enables the two elastic metal sheets to be interconnected or disconnected so as to switch on and off the ignition circuit.

However, it is found by the present inventor that, in the process of using the gas cooker, the plunger is generally operated to rotate and/or to move linearly, for which an operation gap would be inevitably presented between the operation knob operable by the operator and an operation table (or between the plunger and the operation table). Foreign substances such as water, grease, food residues, etc., are apt to penetrate to the underside of the operation table through the operation gap, resulting in jamming, rusting, etc. of the components (e.g., the plunger, the elastic metal sheets) of the switching mechanism, and even resulting in malfunction of the related components and the entire switching mechanism.

To this end, it is provided by the present inventor an improved switching assembly in order to achieve at least one of the following objects: improving the sealing performances, such as waterproofing, anti-corrosion, etc., of the switching assembly, improving the reliability of the ignition circuit, improving the reliability and service life of the switching mechanism and the gas cooker, reducing the cost and simplifying the structure of the switching mechanism, etc.

As mentioned above, the gas valve structure generally includes a plunger operable by an operator. The switching assembly according to the present disclosure may be connected to an existing gas valve structure so as to be operated together with the gas valve structure via an operation knob to thereby switch the on or off state of the ignition circuit. This structural arrangement can make the switching mechanism more compact and easier to implement.

According to an embodiment of the present disclosure, the switching assembly may include a permanent magnet and a reed switch. The reed switch may be connected to the ignition circuit of the gas cooker by a cable. The permanent magnet may be carried by a permanent magnet carrier. The permanent magnet carrier may be connected to the plunger of the gas valve structure so as to move between an initial position and a working position together with the plunger. Thus, the permanent magnet may be away from or close to the reed switch as the permanent magnet carrier moves, thereby controlling the reed switch such that it is switched off or switched on, which in turn may switch off or switch on the ignition circuit. When the permanent magnet carrier is in the initial position, the permanent magnet is away from the reed switch, leaving the reed switch free from the magnetic effect of the permanent magnet and thus is maintained in its original off or on state. When the permanent magnet carrier is moved to its working position with the plunger, the permanent magnet may get close to the reed switch to exert a magnetic effect on the reed switch to switch on or off the reed switch, which thereby may further control the switching on or off of the ignition circuit connected to the reed switch. Advantageously, a sealing structure may be provided to seal the connection segment (or connection portion) between the reed switch and the cable from the environment in which the switching assembly is located (for example, the environment where the region under the gas cooker top is located) to prevent water, grease and other foreign substances from adversely affecting the ignition circuit, improve the performance of the switching assembly and the ignition circuit, and further improve the use reliability and service life of the switching assembly and the ignition circuit.

The switching assembly according to the present disclosure is further described in detail hereinafter with reference to FIGS. 1 to 13.

FIG. 1 shows a partial structural schematic view of a switching mechanism 10 for a gas cooker according to an embodiment of the present disclosure. As shown in FIG. 1, the switching mechanism 10 may include a switching assembly 100 and a gas valve structure 200. The gas valve structure 200 may include a plunger 201 operable by an operator (e.g., operable via an operation knob mounted on an end of the plunger) and a valve housing 202 that receives the plunger 201. In the embodiment shown in FIG. 1, the plunger 201 can be rotated through the operator's operation to allow gas to pass through. Before the operator operates the plunger 201, the plunger 201 is in a rest state, gas cannot pass through the gas valve structure 200, and when the plunger 201 is rotated a predetermined angle in a clockwise or counterclockwise direction through the operator's actuation, gas may flow through the gas valve structure 200. The switching assembly 100 may be connected to an ignition circuit (e.g., the ignition circuit shown in FIG. 13) of the gas cooker via a cable 300.

FIGS. 2 to 7 show details of the switching assembly 100 in FIG. 1 according to an embodiment of the present disclosure. As shown in FIGS. 2 to 7, the switching assembly 100 may include a permanent magnet 120 and a reed switch 140.

A structure for carrying the permanent magnet may be provided to allow the permanent magnet to move away from or get close to the reed switch, thereby affecting the state of the reed switch. According to the present disclosure, the switching assembly 100 may further include a permanent magnet carrier 110. The permanent magnet 120 may be fixed to the permanent magnet carrier 110. The permanent magnet carrier 110 may be fixedly connected to the plunger 201 to move between an initial position and a working position with the plunger 201 such that the permanent magnet 120 is away from or close to the reed switch 140. When the permanent magnet 120 is away from the reed switch 140, the reed switch can maintain its initial state (e.g., an off state). When the permanent magnet 120 is moved close to the reed switch 140 to exert a magnetic effect on the reed switch, the reed switch 140 may be switched to an on state.

Both ends of the reed switch 140 may be connected to the ignition circuit (please refer to FIG. 13) of the gas cooker via the cable 300. The connection segment between the reed switch 140 and the cable 300 may be in a sealed state with respect to the environment in which the switching assembly 10 is located. For example, the electrical connection portion between the reed switch 140 and the cable 300 and even the whole of the reed switch 140 and the cable 300 may be protected by means of potting, resin sealing, etc., to prevent foreign substances such as water, grease, and the like entering via the aforementioned operation gap from corroding or damaging the connection segment between the reed switch 140 and the cable 300, which can improve the performance, such as waterproofing, anti-corrosion, etc., of the switching assembly and improve the use reliability and service life of the switching assembly.

Advantageously, a structure for carrying the reed switch 140 may be provided so as to fixedly hold the reed switch 140. According to an embodiment of the present disclosure, the switching assembly 100 may further include a reed switch carrier 130. The reed switch 140 may be carried (fixed or supported) on the reed switch carrier 130. The reed switch carrier 130 may be fixedly supported at an appropriate location on the gas valve structure 200 (e.g., in an embodiment of the present disclosure, the reed switch carrier 130 is supported on the valve housing 202 of the gas valve structure 200). Thereby, the reed switch 140 may switch between the off and on states in response to the moving away or approaching of the permanent magnet 120.

It can be understood that the positional relationship between the permanent magnet 120 and the reed switch 140 should be configured such that, a distance or an included angle between the permanent magnet 120 and the reed switch 140 is sufficient to cause the permanent magnet 120 not to exert a magnetic effect on the reed switch 140 when the permanent magnet carrier 110 is in the initial position; and a distance or an included angle between the permanent magnet 120 and the reed switch 140 is sufficient for the permanent magnet 120 to exert a magnetic effect on the reed switch 140 to switch the on or off states of the reed switch 140 when the permanent magnet carrier 110 is in the working position.

According to an embodiment of the present disclosure, the reed switch carrier 130 may include a housing part 131 which may be fixed to the gas valve structure 200. For example, as further described below, the housing part 131 may be fitted over the plunger 201 and be further fixedly supported on other components (e.g., the valve housing 202) of the gas valve structure 200. Alternatively, the housing part 131 may be fixed onto the gas valve structure 200 through an attachment bracket. The reed switch 140 may be arranged inside the housing part 131 such that the reed switch 140 and the cable 300 may be connected to each other in the region of the housing part 131.

It can be understood that the reed switch carrier 130 is not necessarily to be fixed onto the gas valve structure 200, it can also be supported or fixed onto other structural parts of the gas cooker, or it can be supported or fixed by a special structure.

According to the present disclosure, the housing part 131 may be of an open box structure. Alternatively, as shown in (a) of FIG. 6, the reed switch 140 may be fitted in the housing part 131 in a snap-fit manner. To this end, two or more tabs 1313 may be provided on a bottom 1311 of the housing part 131. Alternatively, the reed switch 140 may be integrally molded in the housing part 131.

Figure 6:
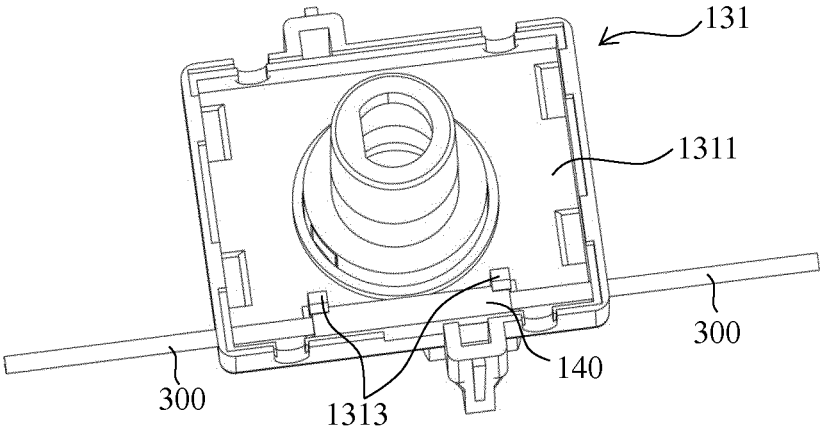
FIG. 6 schematically shows an assembled view of a reed switch with a reed switch carrier according to an embodiment of the present disclosure.
Figure 6:
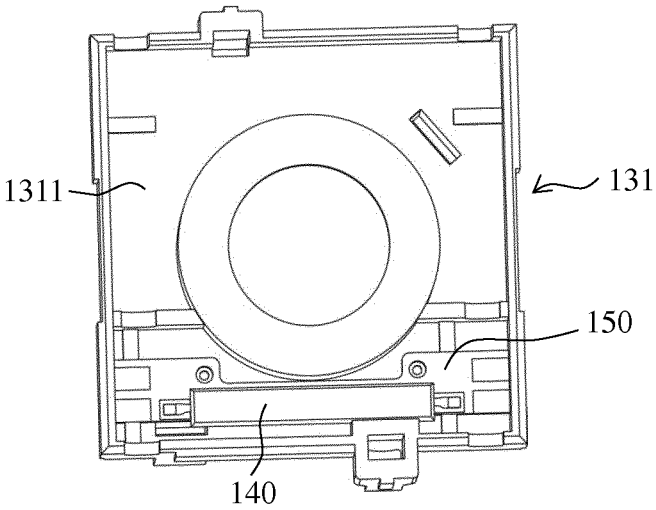

Advantageously, as shown in FIG. 6(*b*), the switching assembly 100 may include a PCB (printed circuit board) 150 in the housing part 131. The PCB may be fixed in the housing part 131 by screws or in a snap-fit manner. Both ends of the reed switch 140 and the cable 300 may be welded on the PCB 150. Thus, the connection between the reed switch 140 and the cable 300 can be realized through the PCB 150.

A sealing structure for sealing the connection segment between the reed switch 140 and the cable 300 from the environment in which the switching assembly 10 is located may include a sealant covering the connection segment.

For example, the sealant (or an isolation material, such as an epoxy, or an elastomeric material) may be applied only on the connection segment between the reed switch 140 and the cable 300. According to practical requirements and practical structural arrangement, a sealant may be applied in all or a portion of the region of the housing part 131.

With this structural arrangement, the connection segment between the reed switch 140 and the cable 300 can be in a sealed state with respect to the environment in which the switching assembly 10 is located, which therefore can protect the ignition circuit from being adversely affected by foreign substances such as water, grease, from the outside. Therefore, the use reliability and service life of the ignition circuit can be improved, which in turn can improve the use reliability and stability of the switching mechanism of the gas cooker and the gas cooker itself. In a case where the switching assembly according to the present disclosure is applied to other switching mechanisms or electrical circuits, the performance of the switching mechanisms or the electrical circuits may be improved as well.

Figure 2:
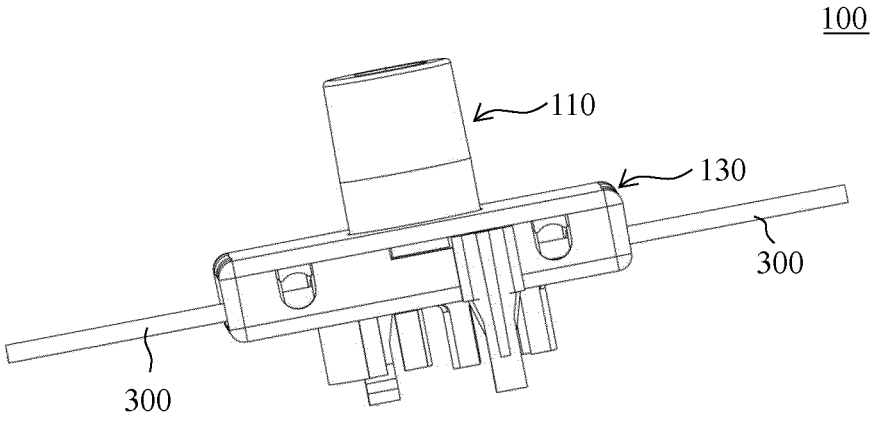
FIG. 2 shows a schematic perspective view of a switching assembly according to an embodiment of the present disclosure.
Figure 3:
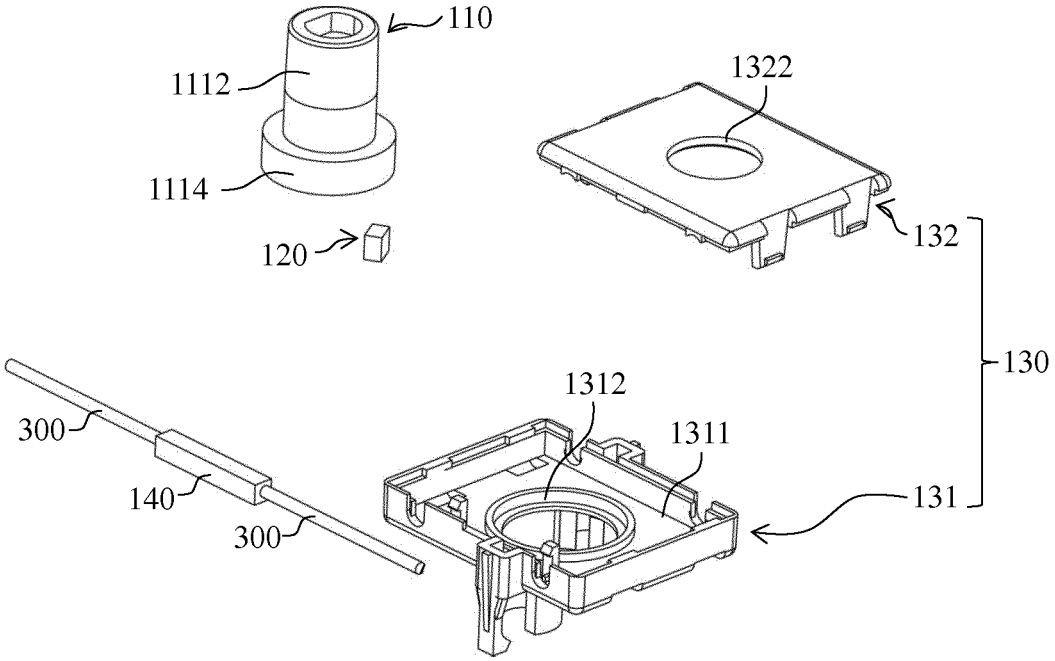
FIG. 3 shows a schematic exploded view of the switching assembly in FIG. 2.
Figure 4:
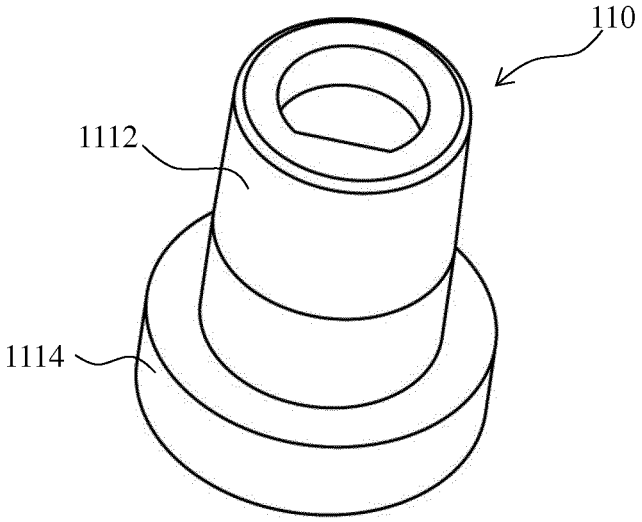
FIG. 4 shows a schematic perspective view of a permanent magnet carrier according to an embodiment of the present disclosure.

As shown in FIGS. 2 to 3, the reed switch carrier 130 may include a cover part 132. The cover part 132 may be covered on an opening of the housing part 131 in a shape-matching manner such that the cover part 132 may define a hollow cavity together with the housing part 131. Thus, both the reed switch 140 and the connecting segment (or the connection portion) between the reed switch 140 and the cable 300 may be accommodated in the hollow cavity. Therefore, the reed switch 140 and the connection segment between the reed switch 140 and the cable 300 accommodated in the hollow cavity may be further isolated from the environment in which the switching assembly 10 is located, which in turn may further improve the stability of the switching assembly and the ignition circuit.

Advantageously, the permanent magnet carrier 110 may be fitted over the plunger 201 so as to move with the plunger 201. In this way, it is not necessary to make any changes to the plunger of the existing gas valve structure, but only need to provide a permanent magnet carrier that matches the plunger. Therefore, the application convenience of the switching assembly according to the present disclosure can be improved.

It can be understood that the permanent magnet carrier may be fixedly connected to the plunger 201 in other feasible ways in addition to those disclosed in the present application and is not limited by this disclosure. For example, an additional support structure may be provided such that the permanent magnet carrier is be fixedly connected to the plunger by the additional support structure. Alternatively, the plunger may be partially modified to facilitate the fixed connection of the permanent magnet carrier thereto.

As shown in FIGS. 2 to 7, the permanent magnet carrier 110 may be a cylindrical member that can be fitted, through its inner peripheral wall, over the plunger 201. For example, the inner peripheral wall of the cylindrical member may have the same cross-sectional shape as that of the plunger 201, such that the permanent magnet carrier 110 can move together with the plunger 201. In the embodiment shown in FIG. 1, the plunger 201 may have a D-shaped cross section. Thus, the inner peripheral wall of the cylindrical member may also have a D-shaped profile so as to be fitted and fixed to the plunger 201.

Specifically, the permanent magnet carrier 110 may include a small-diameter portion 1112 and a large-diameter portion 1114. The large-diameter portion 1114 has a diameter greater than that of the small-diameter portion 1112. This structural arrangement may save the space occupied by the permanent magnet carrier and the material costs.

The bottom 1311 of the housing part 131 may be provided with a first through hole 1312 which may have a diameter greater than that of the plunger 201 such that the housing part 131 would not move with the plunger 201. The housing part 131 may be fitted over the plunger 201 by means of the first through hole 1312 in the bottom 1311 thereof and further fixedly supported on the gas valve structure 200 (e.g., supported on the valve housing 202). In the case that the cover part 132 is provided, the cover part 132 may also correspondingly be provided with a second through hole 1322. Thus, the first through hole 1312 and the second through hole 1322 may constitute a through hole penetrating through the reed switch carrier 130. When installed in place, the plunger 201 may extend through the through hole.

Figure 7:
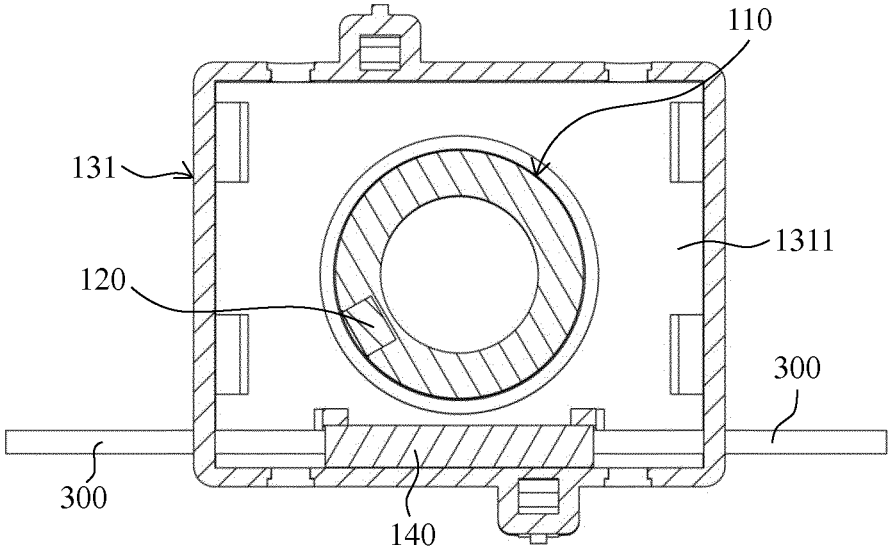
FIG. 7 schematically shows in (a) and (b) an initial state and a working state of a switching assembly according to an embodiment of the present disclosure, respectively.
Figure 7:
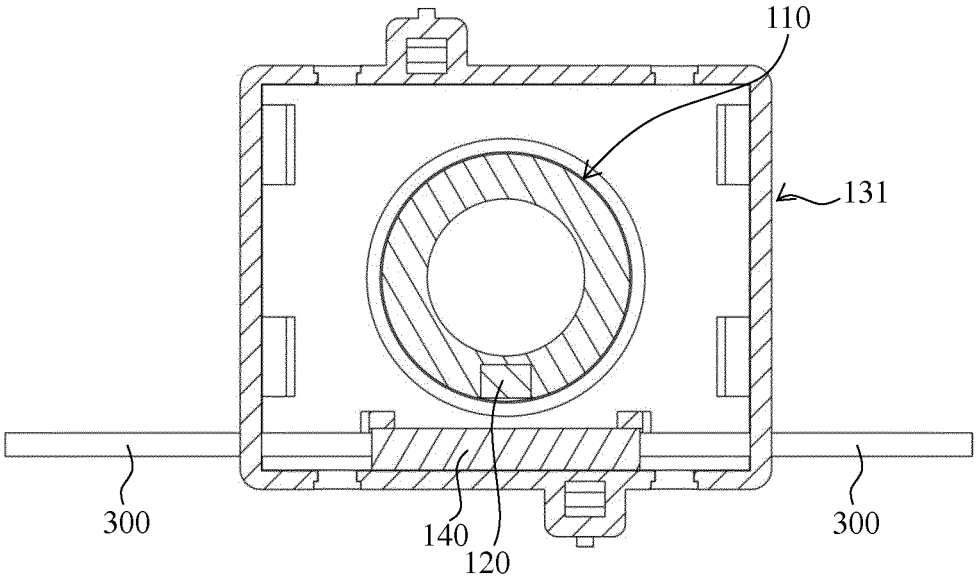

In a mounted state (i.e., the switching assembly according to the present disclosure is mounted on the plunger), the permanent magnet carrier 110 and the reed switch carrier 130 may be sequentially sleeved on the plunger 201. The permanent magnet carrier 110 may be located above the reed switch carrier 130. The large-diameter portion 1114 of the permanent magnet carrier 110 may abut on the bottom 1311 of the housing part 131. The permanent magnet 120 may be arranged in the wall of the large-diameter portion 1114 and adjacent to the bottom 1311 of the housing part 131. The reed switch 140 may be mounted on the bottom 1311 of the housing part 131 near a side wall of the housing part 131. With this arrangement, the permanent magnet 120 may be substantially in the same horizontal plane as the reed switch 140. As shown in (a) of FIG. 7, when the permanent magnet carrier 110 is in the initial position, the distance between the permanent magnet 120 and the reed switch 140 or the included angle between the two is large such that the permanent magnet 120 could not exert magnetic effect on the reed switch 140. Therefore, the reed switch is in the off state and thus the ignition circuit will remain in its off state. When the permanent magnet carrier 110 is rotated with the plunger 201 at a certain angle to approach the reed switch 140, as shown in FIG. 7(*b*), the permanent magnet 120 exerts a magnetic effect on the reed switch 140 such that the reed switch 140 is switched on. As a result, the ignition circuit is also switched on.

As shown in FIG. 2, in the case that the cover part 132 is provided, the large-diameter portion 1114 may be located in the hollow cavity defined by the housing part 131 and the cover part 132. The small-diameter portion 1112 may extend through the second through hole 1322 in the cover part 132. Thus, the permanent magnet 120 assembled in the large-diameter portion 1114 may also be accommodated in the hollow cavity defined by the cover part 132 and the housing part 131, and the reed switch 140 and the connection segment between the reed switch and the cable are both located in the hollow cavity, which further improves the performance of the switching assembly.

A groove may be provided in the permanent magnet carrier 110 (for example, a groove may be provided in the wall of the large-diameter portion 1114), and the permanent magnet 120 may be embedded in the groove in the wall of the large-diameter portion 1114. Advantageously, the permanent magnet may be integrally molded in the permanent magnet carrier 110 (e.g., molded in the wall of the large-diameter portion 1114), in this case, the permanent magnet may be stably held in the permanent magnet carrier, which may further improve the performance of the switching assembly.

Alternatively, the permanent magnet 120 may be in a different horizontal plane from the reed switch 140. For example, in an embodiment not shown, the reed switch carrier 140 may be arranged above or below the permanent magnet carrier 110 such that when the permanent magnet carrier 110 is in the initial position (i.e., a position in which the permanent magnet 120 is away from the reed switch 140), the permanent magnet 120 could not exert a magnetic effect on the reed switch 140. However, when the permanent magnet carrier 110 is rotated to the working position (i.e., a position in which the permanent magnet is close to the reed switch 140), the permanent magnet 120 exerts a magnetic effect on the reed switch 140 so as to switch on the ignition circuit.

Figure 5:
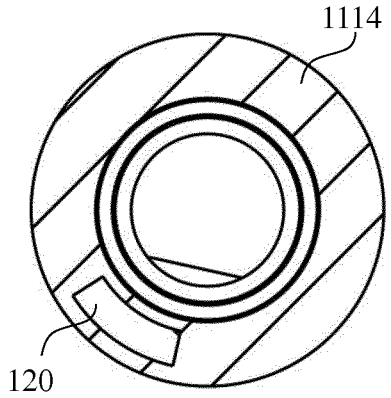
FIG. 5 shows a schematic view of a permanent magnet in a permanent magnet carrier according to an embodiment of the present disclosure in a cross-sectional view.

In the present embodiment, as shown in FIG. 5, the permanent magnet 120 may have a sector shape. Optionally, the permanent magnet 120 may have a rectangular shape or other shapes suitable for exerting a magnetic effect on the reed switch 140 through the rotation of the permanent magnet carrier 110.

FIG. 8 shows a switching mechanism 10' according to another embodiment of the present disclosure. Different from the switching mechanism 10 shown in FIG. 1, in the switching mechanism shown in FIG. 8, the plunger 201' of the gas valve structure 200' may be pressed by an operator to move linearly (for example, in a case that the gas cooker is horizontally arranged, the plunger 201' may be moved up and down). Thus, the switching assembly 100' according to this embodiment may have a structure different from that of the switching assembly 100 in FIG. 1. For example, the permanent magnet carrier 110' may be moved between the initial position and the working position with the linear movement of the plunger 201'. Alternatively, the plunger 201' may be rotated and linearly moved simultaneously through the operator's operation (for example, in the case that the gas cooker is arranged horizontally, the plunger 201' may be moved up and down and rotated). In this case, the permanent magnet carrier 110' may be moved between the initial position and the working position with the rotation and the linear movement of the plunger 201'.

The switching assembly 100' according to another embodiment of the present disclosure is further described below with reference to FIGS. 8 to 12. It may be understood that, similar to the switching assembly 100, the switching assembly 100' may include a permanent magnet carrier 110', a permanent magnet 120', a reed switch 140', and a reed switch carrier 130'. The reed switch 140' may have the same structure as that of the reed switch 140 of the switching assembly 100. Both ends of the reed switch 140' may be connected to the ignition circuit through cables 300. The permanent magnet 120' may have the same or a different shape from that of the permanent magnet 120.

As shown in FIGS. 8 to 12, the permanent magnet carrier 110' may be a thin plate-shaped member, and may have a fitting hole at its center so as to be able to be sleeved and fixed onto the plunger 201'. The fitting hole in the center of the permanent magnet carrier 110' may have different forms according to the cross-sectional shape of the plunger 201' and the practical requirements, which is not specifically limited herein. According to practical requirements, the permanent magnet carrier 110' may have different shapes. In the embodiment shown in FIG. 8, the permanent magnet carrier 110' is a circular plate member.

Similar to the arrangement of the permanent magnet 120 on the permanent magnet carrier 110, the permanent magnet 120' may be embedded into the permanent magnet carrier 110' or be integrally molded with the permanent magnet carrier 110'. In the present embodiment, as shown in (a) and (b) of FIG. 9 and FIG. 10, the permanent magnet 120' is arranged on a lower surface of the permanent magnet carrier 110'.

The reed carrier 130' may be fixed to the gas valve structure 200' below the permanent magnet carrier 110'. As such, in the initial state, the permanent magnet 120' and the reed switch 140' may be arranged in different horizontal planes such that the permanent magnet 120' can approach or be away from the reed switch 140' in response to the linear movement of the permanent magnet carrier 110'.

As can be appreciated, since the permanent magnet 120' will move with the permanent magnet carrier 110' together with the linear movement of the plunger 201', the distance between the permanent magnet 120' and the reed switch 140' should be sufficient such that when the permanent magnet carrier 110' is in its initial position, the reed switch 140' could be free from the magnetic effect of the permanent magnet 120'. However, when the permanent magnet carrier 110' is moved to its working position, the reed switch 140' may be switched on or off under the magnetic effect of the permanent magnet 120'.

It may also be appreciated that in an embodiment not shown, the reed switch carrier 130' may be fixed to the gas valve structure 200' above the permanent magnet carrier 110'. Accordingly, the permanent magnet 120' may be arranged on an upper surface of the permanent magnet carrier 110'.

According to a practical situation, the permanent magnet 120' may have a rectangular shape, a sector shape, an annular shape, or the like. The correspondence between the permanent magnet 120' and the reed switch 140' may be determined according to the practical conditions. For example, in a case that the plunger 201' may only be moved linearly, the permanent magnet 120' may be arranged in alignment with the reed switch 140' in a vertical direction. In a case that the plunger 201' may be moved linearly as well as rotated at the same time, in the initial position, the permanent magnet 120' and the reed switch 140' may have a predetermined angle therebetween. Of course, in a case that the permanent magnet 120' is in an annular shape, the reed switch 140' may be arranged at any suitable position below or above the permanent magnet.

Figure 11:
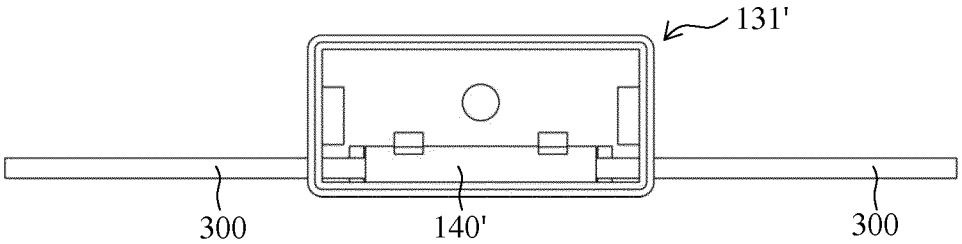
FIG. 11 schematically shows an assembled view of a reed switch with a reed switch carrier according to another embodiment of the present disclosure.
Figure 11:
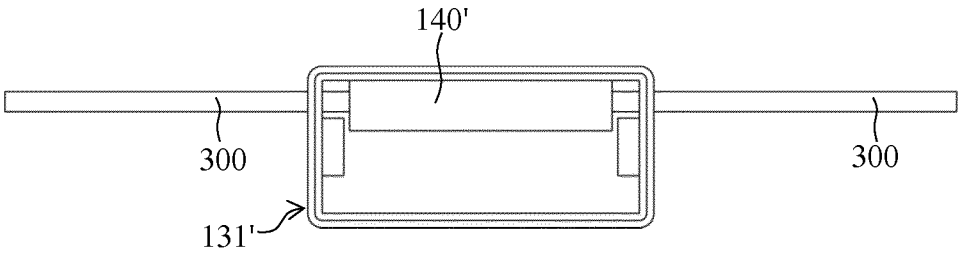

Similar to the structure previously described with reference to FIGS. 2 and 3, as shown in (a) and (b) of FIG. 11, the reed switch carrier 130' may include a housing part 131'. There may be no through hole in the bottom of the housing part 131'. The housing part 131' may be fixed to a valve housing 202' of the gas valve structure 200' via an attachment bracket.

Similar to the arrangement of the reed switch 140 in the housing part 131 of the reed switch carrier 130, the reed switch 140' may be arranged in the housing part 131' in a snap-fit manner, or the reed switch 140' may be molded integrally with the housing part 131', or a PCB may be provided such that the reed switch 140' and the cable are connected together. Also, a sealing structure including a sealant may also be provided. For example, a sealant may be provided only on a connection segment between the reed switch 140' and the cable or in the entire inner cavity of the housing part 131' such that the connection segment between the reed switch 140' and the cable is in a sealed state.

Similarly, the reed switch carrier 130' may further have a cover part 132'. In the case that the cover part 132' is provided, the cover part 132' can also be attached to the gas valve structure by an additional attachment bracket, as shown in FIG. 8. As such, a hollow cavity may be defined by the housing part 131' and the cover part 132' of the reed switch carrier 130', so as to allow the reed switch 140' and the connection segment between the reed switch 140' and the cable 300 to be in a further isolated state. Thus, the performance of the switching assembly may be further improved, and the use stability and service life of the switching assembly may be further improved.

Figure 12:
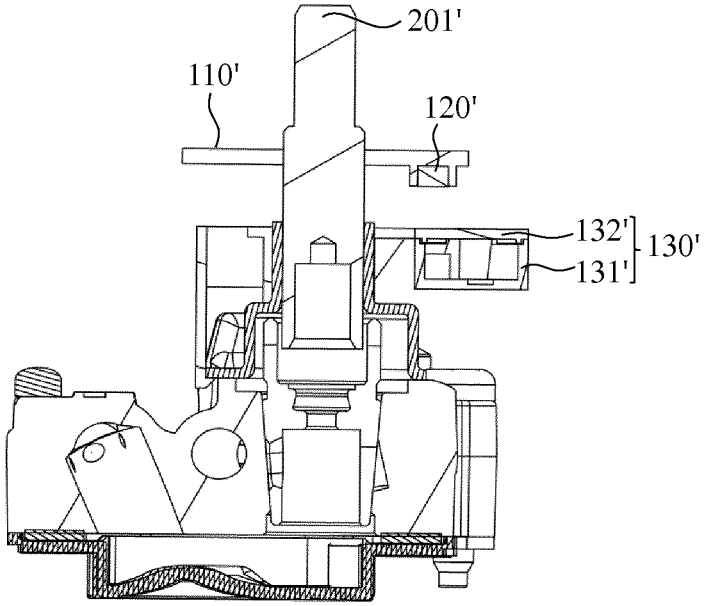
FIG. 12 schematically shows in (a) and (b) an initial state and a working state of a switching assembly according to another embodiment of the present disclosure, respectively.
Figure 12:
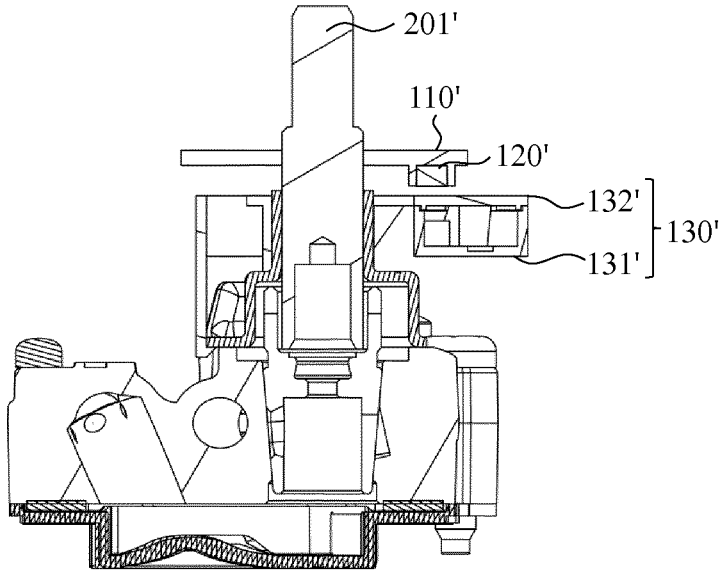

According to the present embodiment, when the permanent magnet carrier 110' is in the initial position, as shown in (a) of FIG. 12, the permanent magnet 120' is away from the reed switch 140', and the permanent magnet 120' does not exert any magnetic effect on the reed switch 140', and thus the reed switch 140' may be kept in an off state such that the ignition circuit may maintain its off state. However, when the permanent magnet carrier 110' is moved linearly (for example, is moved downwards and is rotated simultaneously) to the working position, as shown in (b) of FIG. 12, the permanent magnet 120' may get close to the reed switch 140' to exert a magnetic effect on the reed switch 140' such that the ignition circuit is switched on.

Figure 13:
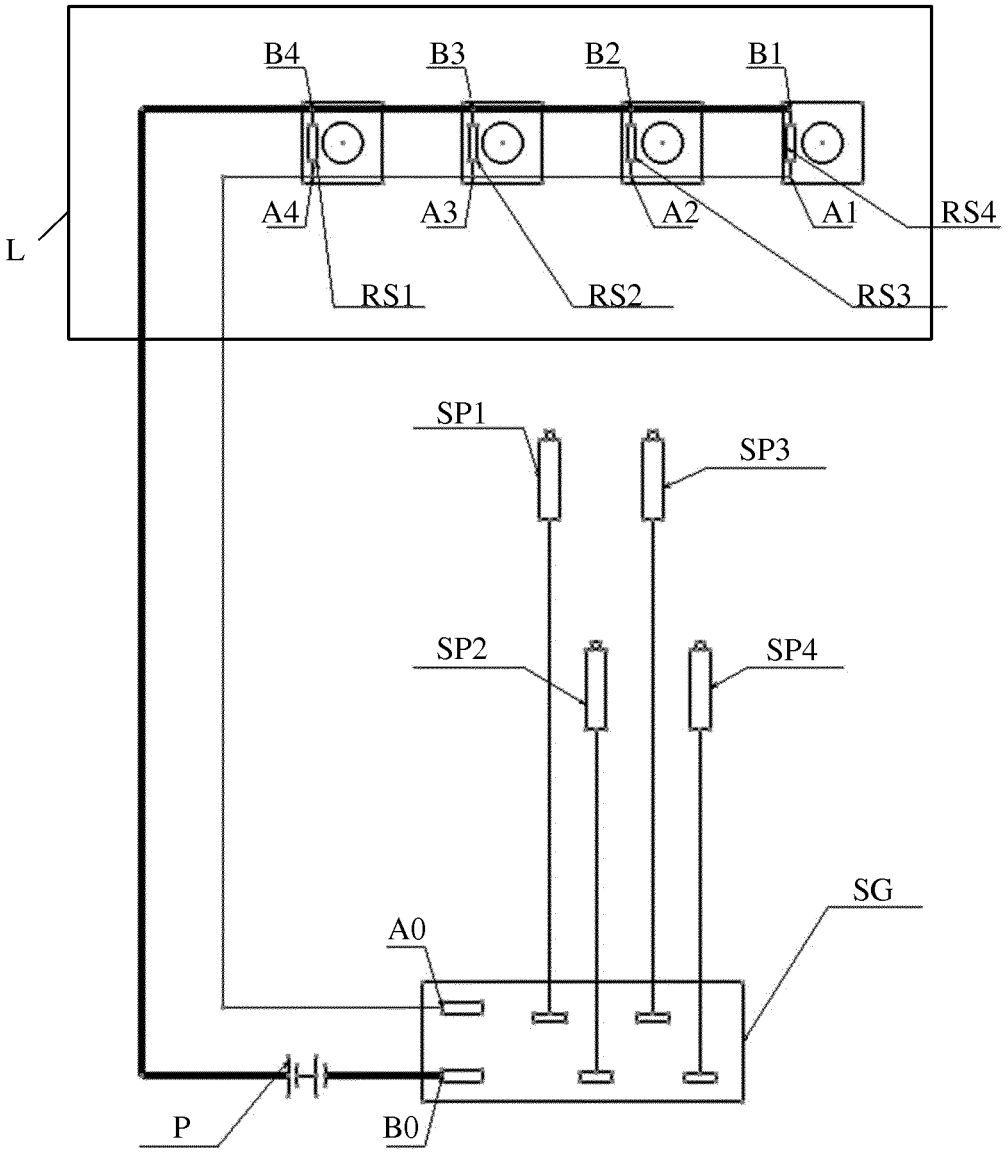
FIG. 13 shows the application of the switching assembly according to the present disclosure in an ignition circuit.

According to the present disclosure, the reed switch 140, 140' of the switching assembly 100, 100' may be connected to the ignition circuit of the gas cooker via the cables 300. FIG. 13 shows the application of the switching assembly according to the present disclosure to an ignition circuit. In the embodiment shown in FIG. 13, four ignition circuits are provided, each of which is connected with a reed switch (RS1, RS2, RS3, RS4, respectively) of the switching assembly according to the present disclosure. In addition, each of the ignition circuit includes a spark plug (SP1, SP2, SP3, SP4, respectively) and a spark generator SG. The four ignition circuits can share one power supply P. Alternatively, each of the ignition circuits may have its own power supply.

When the switching assemblies are actuated through the plungers of the gas valve structures, the permanent magnets may be brought close to the reed switches RS1, RS2, RS3, RS4 such that the reed switches RS1, RS2, RS3, RS4 are switched on, thereby switching on the ignition circuits. As a result, the spark plugs SP1, SP2, SP3, SP4 can generate sparks.

The four ignition circuits shown in FIG. 13 are named from left to right as circuit 1, circuit 2, circuit 3, and circuit 4 respectively. For the circuit 1, its circuit is BO-B4-A4-A0; for the circuit 2, its circuit is BO-B3-A3-A0; for the circuit 3, the circuit is BO-B2-A2-A0; and for the circuit 4, its circuit is BO-B1-A1-A0. B1-B4 and A1-A4 each indicate a connection point of a reed switch to a cable in a corresponding circuit.

It can be seen that, the reed switches are connected to the cables in a sealed manner. Therefore, in the application shown in FIG. 13, the region indicated by the frame line L is in a sealed state, which can prevent the adverse effects of foreign substances such as water and grease from the outside. Therefore, the use reliability and service life of the ignition circuit are greatly improved.

It may be understood that the application shown in FIG. 13 includes four ignition circuits. In other applications, one, two, three, five or more ignition circuits may be provided according to practical requirements. Therefore, it is not limited to the application in the present disclosure.

In addition, according to an embodiment of the present disclosure, the permanent magnet carriers are all sleeved and fixed on the plunger. This structural arrangement further facilitates preventing the plunger from being jammed. In particular, in the embodiment shown in FIG. 8, the permanent magnet carrier is in the form of a plate, which may be covered on the operation gap between the plunger and the valve housing, so as to reduce the risk that the plunger be jammed due to the invasion of external substances.

According to the present disclosure, the permanent magnet and the reed switch are used in the ignition circuit of the gas cooker to control the on/off of the ignition circuit. The permanent magnet can be moved to get close to the reed switch or away from the reed switch with the movement of the plunger, thereby affecting the on or off state of the reed switch. The reed switch and the ignition circuit are connected by the cables, and the connection segment between the reed switch and the cables are in a sealed state. Therefore, the use stability of the ignition circuit is improved, and the operation convenience of the gas cooker and its switching mechanism is improved, the structure is simplified, and the cost is reduced. Furthermore, the sleeved connection of the permanent magnet carrier on the plunger further facilitates reducing the risk that the plunger is jammed by foreign substances, which thereby further improves the performance of the switching mechanism and the gas cooker.

In the present disclosure, the above description was made by taking the application of the switching assembly in a gas cooker as an example. Therefore, the gas cooker and the switching mechanism having the switching assembly described above are also within the protection scope of the present disclosure.

It can be understood that, the switching assembly according to the present disclosure is not limited to be applied to the gas cooker. For example, a plunger that can be rotated and/or linearly moved can be provided to match with the application of the present switching assembly. To this end, a switching mechanism may be provided, and the switching structure may include a plunger and the above-described switching assembly. This kind of switching mechanism may be used in other applications so as to control the on or off state of the electrical circuit.

Specific embodiments and variations of the present disclosure have been specifically described above. However, the person skilled in the art should understand that the present disclosure is not limited to the above-mentioned specific embodiments and variations, but may include various possible combinations and incorporations. For example, the permanent magnet carrier and the reed switch carrier of the switching assembly 100 shown in FIG. 1 may have the same or similar structures as those of the permanent magnet carrier and the breed switch carrier of the switching assembly 100' shown in FIG. 8. Specifically, the permanent magnet carrier 110 may have a plate shape and may be fixedly sleeved on the plunger 201. In this case, the permanent magnet 120 may be embedded into or integrally molded on an upper or lower surface of the plate-shaped permanent magnet carrier 110. Similarly, there may be no through hole in the housing part 131 or the cover part 132 of the reed switch carrier 130. The housing part 131 and the cover part 132 of the reed switch carrier 130 may be fixed to the gas valve structure through another attachment bracket without having to be sleeved on the plunger. Likewise, the permanent magnet carrier and the reed switch carrier of the switching assembly 100' shown in FIG. 8 may also have the same or similar structures as those of the permanent magnet carrier and the reed switch carrier of the switching assembly 100 shown in FIG. 1, the description of which will be omitted herein. Of course, the permanent magnet carrier and the reed switch carrier may have other feasible structures and arrangements depending on the requirements of practical applications.

Although various embodiments of the present disclosure have been described in detail herein, it should be understood that the present disclosure is not limited to the specific embodiments described and illustrated herein in detail, other variations and modifications may be implemented by the person skilled in the art without departing from the spirit and scope of the present disclosure. All these variations and modifications fall within the scope of the present disclosure. Moreover, all the components described here can be replaced by other technically equivalent components.

The invention claimed is:

1. A switching assembly for an ignition circuit of a gas cooker, wherein the gas cooker comprises a gas valve structure configured for passing through and cutting off of the gas, the gas valve structure comprising a plunger operable by an operator and a valve housing configured to receive the plunger, the switching assembly comprising:

a permanent magnet carrier configured to be connected to the plunger to move between an initial position and a working position with movement of the plunger;

a permanent magnet fixed onto the permanent magnet carrier;

a reed switch connectable to the ignition circuit through a cable;

a sealing structure configured to be arranged around a connection segment between the reed switch and the cable such that the connection segment is sealed from an environment where the switching assembly is located, wherein the sealing structure comprises a sealant covering the connection segment between the reed switch and the cable; and a reed switch carrier that carries the reed switch, said reed switch carrier comprising a housing part and a cover part, each defining a through hole dimensioned to receive the plunger therethrough, the reed switch carrier fitting over the plunger, wherein, when the permanent magnet carrier is in the initial position, a distance between the permanent magnet and the reed switch allows the reed switch to be free from an effect of the permanent magnet to thereby maintain the ignition circuit in an off state; and when the permanent magnet carrier is in the working position, the permanent magnet is close to the reed switch such that the reed switch is switched on under the effect of the permanent magnet to thereby switch on the ignition circuit.

2. The switching assembly according to claim 1, wherein the housing part is fixable to the valve housing of the gas valve structure, the housing part has an open box structure, and the connection segment between the reed switch and the cable is located in the housing part.

3. The switching assembly according to claim 2, wherein, the reed switch is fitted in the housing part in a snap-fit manner; or the reed switch is integrally molded with the housing part.

4. The switching assembly according to claim 2, further comprising a printed circuit board mounted in the housing part, wherein the reed switch and the cable are connected to each other by the printed circuit board.

5. The switching assembly according to claim 1, wherein the sealant is provided in the housing part at the connection segment between the reed switch and the cable; or the sealant is provided throughout an interior cavity of the housing part when the reed switch and the cable are installed in place.

6. The switching assembly according to claim 1, wherein the cover part is configured to cover an opening portion of the housing part in a shape-matching manner to define a hollow cavity between the cover part and the housing part, both the connection segment between the reed switch and the cable and the reed switch being accommodated in the hollow cavity.

7. The switching assembly according to claim 6, said through holes of said housing part and cover part having a diameter greater than that of the plunger, and the reed switch carrier can be fitted over the plunger via the through holes and be further fixed onto the valve housing of the gas valve structure.

8. The switching assembly according to claim 7, wherein the permanent magnet carrier is a cylindrical member that can be fitted over the plunger, and wherein the cylindrical permanent magnet carrier comprises a small-diameter portion and a large-diameter portion connected to each other, the permanent magnet being fixed in a wall of the large-diameter portion, and when the permanent magnet carrier is installed the large-diameter portion is located in the hollow cavity of the reed switch carrier.

9. The switching assembly according to claim 6, wherein the permanent magnet carrier is a plate member that can be fitted over the plunger, and the permanent magnet carrier is located above the reed switch carrier when installed.

10. The switching assembly according to claim 6, wherein the reed switch carrier is fixed to the valve housing of the gas valve structure via an attachment bracket.

11. The switching assembly according to claim 10, wherein the permanent magnet carrier is a cylindrical or plate-like member that can be fitted over the plunger.

12. The switching assembly according to claim 1, wherein the permanent magnet carrier is movable between the initial position and the working position as the plunger rotates; or the permanent magnet carrier is movable between the initial position and the working position as the plunger moves linearly; or the permanent magnet carrier is movable between the initial position and the working position as the plunger both rotates and moves linearly.

13. The switching assembly according to claim 1, wherein the permanent magnet is embedded in the permanent magnet carrier or is integrally molded with the permanent magnet carrier.

14. The switching assembly of claim 1, wherein the permanent magnet has a rectangular shape, a sector shape or an annular shape suitable for exerting a magnetic effect on the reed switch as the permanent magnet carrier moves.

15. A switching mechanism for a gas cooker, comprising a gas valve structure configured for passing through and cutting off of the gas, wherein the gas valve structure comprises a plunger operable by an operator and a valve housing receiving the plunger, and the switching mechanism further comprises the switching assembly according to claim 1.

16. A gas cooker, comprising the switching mechanism according to claim 15 and an ignition circuit, wherein the ignition circuit comprises a spark plug, the switching assembly of the switching mechanism being connected in the ignition circuit for switching on or off the ignition circuit.

17. A gas cooker comprising first and second gas valves configured to control a flow of gas therethrough, first and second parallel ignition circuits respectively configured to generate sparks to ignite gas delivered via the first and second gas valves, and a first and second switching assemblies adapted to close the respective first and second ignition circuits in order to generate said sparks;

each said gas valve comprising a valve housing and a plunger received thereby, said plunger being movable relative to the valve housing via at least one of rotation or linear translation;

each said switching assembly comprising:

a reed switch carrier comprising a housing part and a cover part fixed to the valve housing and defining a hollow cavity, said housing part and cover part each defining a through hole dimensioned to receive said plunger therethrough, the reed switch carrier fitting over the plunger, a reed switch fixed to the reed switch carrier and disposed within the hollow cavity thereof, the reed switch being connected to a cable, a sealing structure configured to be arranged around a connection segment between the reed switch and the cable such that the connection segment is sealed from an environment where the switching assembly is located, wherein the sealing structure comprises a sealant covering the connection segment between the reed switch and the cable, a permanent magnet carrier fixedly coupled to said plunger so as to move in unison therewith, and a permanent magnet affixed to the permanent magnet carrier, said reed switch being connected within the respective ignition circuit via connection segments that are sealed from a surrounding environment so as to isolate and protect the connection segments, said permanent magnet being movable in response to movement of the plunger, and thereby of the permanent magnet carrier, into and out from a working position of the permanent magnet, wherein an arrangement of said permanent magnet in the working position and said reed switch is such that the permanent magnet exerts a magnetic force on said reed switch sufficient to operate the reed switch thereby closing the respective ignition circuit, and wherein outside of said working position the permanent magnet does not exert sufficient magnetic force on the reed switch to operate the same such that the respective ignition circuit is open when the permanent magnet is not in said working position.

18. The gas cooker according to claim 17, said switching assembly being fitted over the plunger of the respective gas valve such that the plunger passes through the reed switch carrier thereof, the reed switches of each said switching assembly being connected via its respective connection segments within the respective reed switch carrier to common first and second cables passing through the reed switch carrier, said first and second cables connect each of said reed switches to a common spark generator, wherein a sealant fills the hollow cavity of each said reed switch carrier.

* * * * *